United States Patent [19]

Schrawer et al.

[11] 4,009,013

[45] Feb. 22, 1977

[54] PROCESS FOR THE PRODUCTION OF SLUSH OF LOW-BOILING GASES

[75] Inventors: Rolf Schrawer, Bruchkobel; Josef Bardenheier, Frankfurt am Main; Jurgen Koch, Mannheim, all of Germany

[73] Assignee: Messer Griesheim GmbH, Frankfurt am Main, Germany

[22] Filed: May 12, 1975

[21] Appl. No.: 576,848

[30] Foreign Application Priority Data

May 15, 1974 Germany ..... 2423610

[52] U.S. Cl. ..... 62/10; 62/12

[51] Int. Cl.[2] ..... F25J 1/00; F25J 5/00

[58] Field of Search ..... 62/10, 12

[56] References Cited

UNITED STATES PATENTS

| | | | |
|---|---|---|---|
| 1,818,816 | 8/1931 | Rufener et al. | 62/10 |
| 1,870,691 | 8/1932 | Rust et al. | 62/10 |
| 1,884,313 | 10/1932 | Small | 62/10 |
| 1,927,173 | 9/1933 | Jones et al. | 62/10 |
| 2,738,658 | 3/1956 | Bronson | 62/10 |
| 3,354,662 | 11/1967 | Daunt | 62/10 |

*Primary Examiner*—Jack Sofer

*Attorney, Agent, or Firm*—Connolly and Hutz

[57] ABSTRACT

A process for preparing fine-grained slush of low-boiling gases is characterized in that the liquefied gas or the very cold gas under high pressure is relieved from stress in a nozzle alternately first to a pressure below the pressure of the triple point in the gas-ice range and subsequently to a pressure above the pressure of the triple point in gas-liquid range.

5 Claims, 6 Drawing Figures

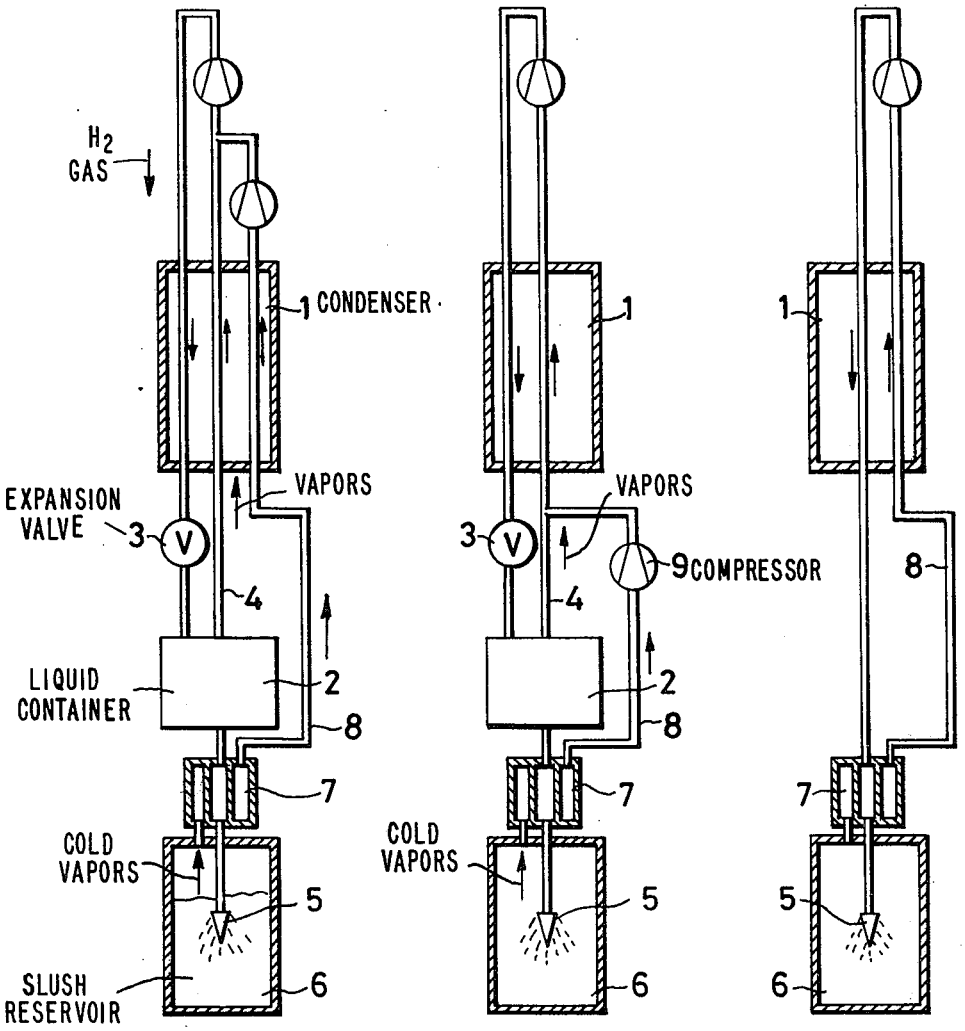
FIG.3 FIG.4 FIG.5
FIG.6
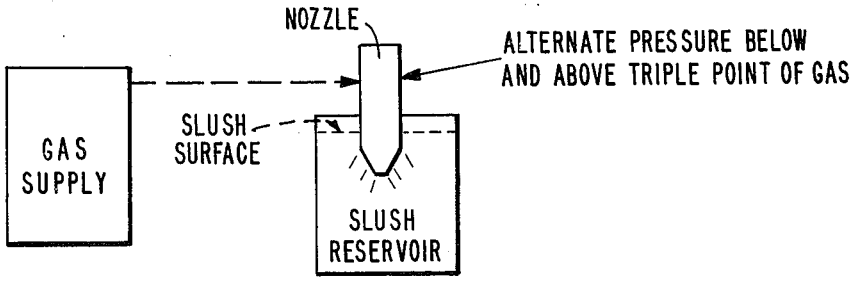

PROCESS FOR THE PRODUCTION OF SLUSH OF LOW-BOILING GASES

BACKGROUND OF THE INVENTION

The invention relates to a process for the production of fine-grained slush of low-boiling gases, such as e.g. nitrogen or hydrogen. Slush is a mixture of liquid and ice, which is at the triple point, in equilibrium with the gas phase.

Because of its good transportation, heat-transfer and storage properties, the slush of low-boiling gases is suited better than the corresponding boiling point liquid, as a refrigerating medium, in particular in the cases, in which a high refrigerating efficiency at a low temperature level is required for a limited period. This is the case, for example, for many physical experiments. However, slush can be used very well also for continuous cooling, e.g. of supraconductors.

Slush of low-boiling gases, has been prepared up to now according to the pumping down process. In such process liquefied, low-boiling gas is in an insulated container. By means of a vacuum pump, gas is continuously pumped out of the gas chamber of the insulated container, which causes a drop in the pressure. Since the liquid has to create the heat of evaporation for the drawn off gas, the liquid cools down. As soon as the triple-point pressure is reached, the ice formation starts.

In such techniques, ice is formed first on the surface. By periodical changing of the suction ability of the vacuum pump, sub-surface ice formation can be initiated, and the mixing of the ice with the liquid to slush can be effected. For a shortening of the process, it is also known to release the boiling-point liquid in a nozzle, arranged in the reservoir, to the triple point pressure, and to initiate subsequently the ice formation by sucking off the gas obtained by means of a vacuum pump.

The object of each slush production for cooling purposes is to reach an ice portion as large as possible in the slush, otherwise the good transportation properties of the slush are impaired in pipe lines. Therefore, it must be aimed at maintaining the ice particles in the slush as small as possible. In the case of the slush production, according to the pumping off process, this goal is not sufficiently reached. In particular in the case of hydrogen, there is formed on the surface ice of a more crystalline structure, and it is often necessary to destroy crystalline formations by stirring, in order to obtain slush with fine-grained ice.

SUMMARY OF THE INVENTION

The invention has as its object to create a process for the production of especially fine-grained slush of low-boiling gases.

According to the invention, this object is achieved in that the liquefied gas or the low-temperature gas under high pressure is released through a nozzle into a chamber, alternately to a pressure below the pressure of the triple point, into the gas-ice state in the chamber, and subsequently to a pressure above the pressure of the triple point, into the gas-liquid state in the chamber.

With the process according to the invention, there is obtained a much more finer-grained slush, than can be prepared with the pumping off process. The upper grain size is at 3 mm. and goes down to 1 mm. It is also possible to prepare thread-like ice formations, and gel-like slush. A stirring apparatus is not required in any of the cases. Also the composition of the slush can be easily regulated, by varying the period, during which the above and the below the triple point pressure is released through the nozzle.

Because of the irreversibility of the throttle process, the quantity of slush formed per kilogram of liquid gas utilized for an equal ice fraction in the process, is theoretically lower in the process of the invention, than in the pumping off process. However, this disadvantage is compensated for by far by the surprisingly fine grain size of the produced ice.

The periodic change of the releasing pressure takes place preferably at about 5 to 10 seconds. The considerable, obtainable fine-grainage, which is already high, can be increased still further, in that the releasing takes place in the setting of the nozzle which is located below the slush mirror, i.e. the reflective liquefied surface of the slush. By this method, slush can be produced in qualities which had been considered impossible up to now.

For example, according to the process of the invention, upon pressure release below the slush mirror of liquid nitrogen, slush was produced in a gel-like structure, which turns out in oscillations by supply of mechanical energy. Light sent by a mercury high-pressure lamp is weakened more strongly in this slush than in every nitrogen slush produced according to other processes. It is therefore a matter of slush with greatest ice thickness and highest slush quality. Corresponding results are obtained at the preparation of hydrogen slush.

Compared with the pumping-off process, the process according to the invention has the further advantage that slush can be produced continuously, which is in such a case immediately available. On the other hand, slush can be produced with the pumping-off process only discontinuously, since it takes more time until the liquid gas being contained in an insulated container is converted completely into slush. Because of the presence of heat in the storage vessel a higher slush yield can be obtained with the usually more rapid expansion through the nozzle than in the pumping-off process.

THE DRAWINGS

FIGS. 3–5 are schematic diagrams representing, according to the invention, possible production of hydrogen slush; and FIG. 6 illustrates in block diagram the process of this invention as indicated by the legends therein.

DETAILED DESCRIPTION

Figure 1:
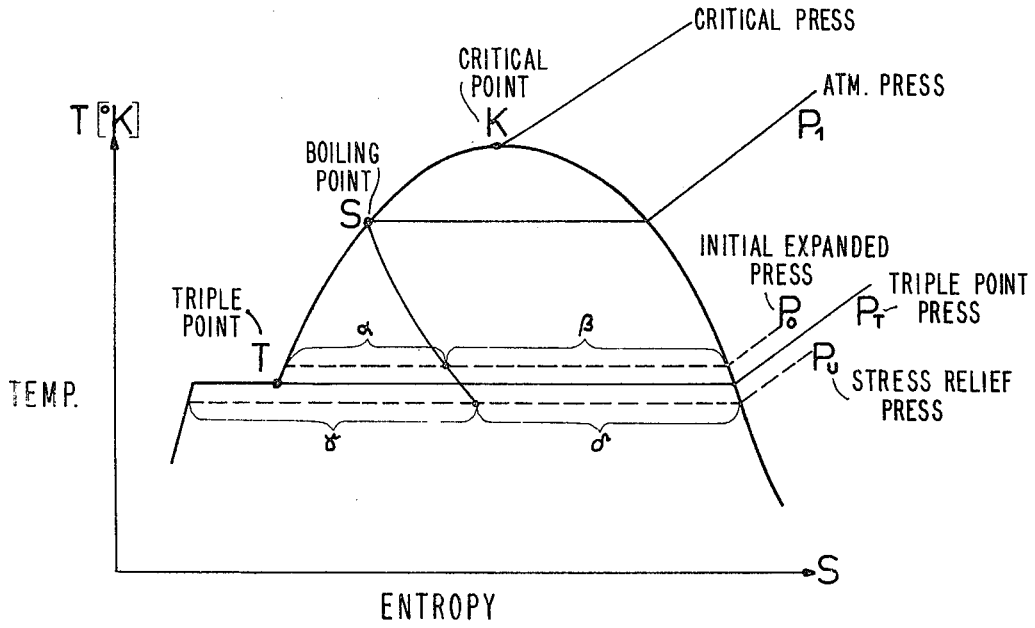
FIG. 1 is a representation of the process according to the invention in the T-S-diagram.

In FIG. I the T (temperature) — S (entropy) — diagram of a low-boiling gas is presented. K is the critical pressure, S the boiling point at e.g. $P_1$=1 atm., T is the triple point and $P_T$ the triple point pressure. The change in condition taking place according to the process of the invention, is represented in the FIG. 1 diagram. Starting from the boiling point S, an isenthalpic expansion takes place, at first to a pressure $P_o$ somewhat above the triple-point pressure $P_T$. From 1 kg. of boiling point liquid there is thereby produced $\beta/\alpha+\beta$ kg. triple-point liquid, and $\alpha/\alpha+\beta$ kg. of gas. After a certain time, e.g. 15 seconds the first stress relieved pressure is again and further lowered to $P_u$ somewhat below the triple point pressure. Thereby $\delta/\gamma+\delta$ of ice and $\gamma/\gamma+\delta$ kg. of gas are produced. Then the pressure is again increased to $P_o$. Therefore, the portion of ice in the forming slush depends upon how long the stress is relieved or expanded to $P_o$ from the boiling point S and how long to $P_u$. The produced gas whirls the slush or sludge around and thus contributes to its homogenization. From time to time also some cold gas can be blown through the nozzle temporarily, in order to whirl the slush around even better.

Figure 2:
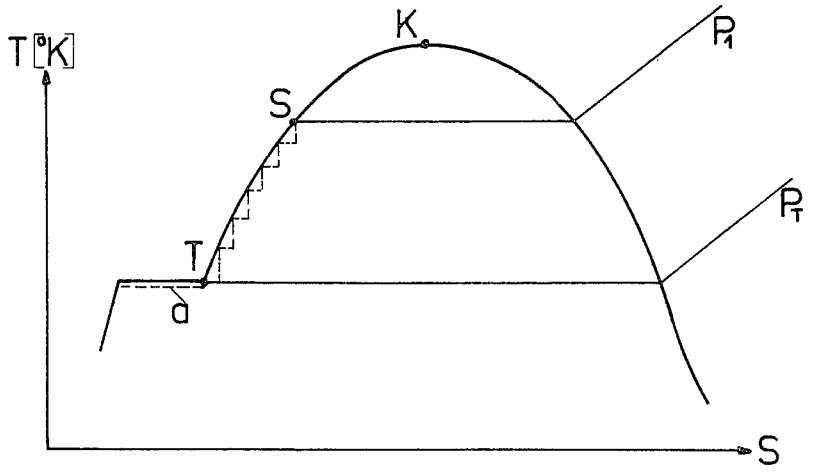
FIG. 2 is a comparative representation of the prior art pumping-off process in the T-S diagram.

In FIG. 2, the pumping-off process is presented in the T-S diagram for comparison. Starting from the boiling point S, a drop in pressure takes place continuously, to the triple-point pressure $P_T$, which can be interrupted due to the rapid temperature changes resulting from sudden pressure variation when the pumping is to rapid. After reaching the triple point T, the formation of ice starts in correspondence to line *a*.

FIG. 3 illustrates a construction for the production of hydrogen-slush, according to the process of the invention. Gaseous hydrogen is liquefied in condenser 1, and is expanded via the valve 3 into the container 2, in which the liquid is located. The vapors being produced return through pipeline 4 into the liquefier or condenser 1. The liquid itself is relieved or expanded from pressure stress through the nozzle 5 in the slush reservoir 6. The cold vapors being formed, return after heat exchange in the heat exchanger 7, through pipe line 8 into the liquefier 1.

FIG. 4 represents a variation of the process of FIG. 3. The cold vapors from the slush reservoir are recompressed in compressor 9, and combined with the vapors in piping 4.

In the process represented in FIG. 5, very cold gas being under high pressure is released from stress, from the liquefier 1 directly through the nozzle 5 via heat exchanger 7.

Therefore, the throttling continues through the wet-vapor range, to the triple line.

What is claimed is:

1. In a process for the preparation of fine-grained slush from a supply of low boiling gases which utilizes therein liquefied gas or very cold gas under high pressure, the improvement comprising relieving a portion of the gas in the supply from stress, by expansion through a nozzle alternately to a pressure below the pressure of the triple point for the formation of slush in the gas-ice region and discharging that portion from the nozzle as snow, then subsequently in 5–10 seconds isenthalpically expanding an additional portion of the gas from the supply to a pressure above the triple point in the gas-liquid region, to discharge that additional portion from the nozzle as liquid by altering the conditions within the nozzle, and continuing to quickly alternate the pressure releasing steps every 5–10 seconds with further portions of gas from the supply to create a fine-grained homogeneous snow and liquid slush mixture having a grain size of 1 mm to 3 mm.

2. In the process of claim 1 wherein the nozzle for relieving the stress is located below the relfective liquefied surface of the slush.

3. A cryotechnique refrigerating medium comprising slush made in accordance with the process of claim 1.

4. In the process of claim 1 wherein the gas is nitrogen.

5. In the process of claim 1 wherein the gas is hydrogen.

* * * * *